US007918497B2

(12) United States Patent
Keegan

(10) Patent No.: US 7,918,497 B2
(45) Date of Patent: Apr. 5, 2011

(54) CONVERTIBLE HIGH CHAIR

(75) Inventor: Charles Keegan, Woonsocket, RI (US)

(73) Assignee: Summer Infant (USA), Inc., Woonsocket, RI (US)

( * ) Notice: Subject to any disclaimer, the term of this patent is extended or adjusted under 35 U.S.C. 154(b) by 41 days.

(21) Appl. No.: 12/407,726

(22) Filed: Mar. 19, 2009

(65) Prior Publication Data

US 2010/0096891 A1 Apr. 22, 2010

Related U.S. Application Data

(60) Provisional application No. 61/037,852, filed on Mar. 19, 2008.

(51) Int. Cl.
*A47C 13/00* (2006.01)
*A47B 83/02* (2006.01)
*A47D 1/10* (2006.01)

(52) U.S. Cl. ..... 297/130; 297/118; 297/148; 297/149; 297/150; 297/151; 297/152; 297/153; 297/154; 297/250.1; 297/256.13; 297/256.16

(58) Field of Classification Search ..... 297/118, 297/130, 148, 149, 150, 151, 152, 153, 154, 297/155, 250.1, 256.13, 256.16
See application file for complete search history.

(56) References Cited

U.S. PATENT DOCUMENTS

RE7,582 E * 3/1877 Stevens ..... 297/130 X
RE8,166 E * 4/1878 Tenney et al. ..... 297/130 X
202,046 A * 4/1878 Perley ..... 297/130
202,788 A * 4/1878 Caulier ..... 297/130 X
213,108 A * 3/1879 Harrison ..... 297/130
217,341 A * 7/1879 Chichester ..... 297/130 X
224,923 A * 2/1880 Kenna ..... 297/130 X
229,061 A * 6/1880 Stevens ..... 297/130 X
231,689 A * 8/1880 Stevens ..... 297/130 X
236,273 A * 1/1881 Stevens ..... 297/130
283,405 A * 8/1883 Kenna ..... 297/130 X
301,662 A * 7/1884 Bliss ..... 297/130 X
313,881 A * 3/1885 Odell ..... 297/130 X
317,001 A * 5/1885 Odell ..... 297/130 X
866,853 A * 9/1907 French ..... 297/130 X
1,147,191 A * 7/1915 Rundle ..... 297/130 X
1,167,524 A * 1/1916 Rundle ..... 297/130 X
2,115,257 A * 4/1938 Felsher ..... 297/130
2,435,733 A * 2/1948 Belyeu ..... 297/130 X
3,115,364 A * 12/1963 Berlin ..... 297/130
3,239,271 A * 3/1966 Bergersen ..... 297/130
3,542,419 A * 11/1970 Spinola ..... 297/130
3,649,074 A * 3/1972 McDonald et al. ..... 297/153
4,113,306 A * 9/1978 von Wimmersperg .... 297/130 X
4,685,688 A * 8/1987 Edwards ..... 297/130 X
4,832,354 A * 5/1989 LaFreniere ..... 297/130 X
4,946,180 A * 8/1990 Baer ..... 297/155 X
5,201,535 A * 4/1993 Kato et al. ..... 297/130 X
5,238,291 A * 8/1993 Alionis ..... 297/118
5,348,374 A * 9/1994 Kuo ..... 297/151 X
(Continued)

*Primary Examiner* — Rodney B White
(74) *Attorney, Agent, or Firm* — Sunstein Kann Murphy & Timbers LLP

(57) ABSTRACT

A chair includes a base portion, and a seat portion supported by the base portion. The seat portion is configurable in at least two modes. In the first mode, the seat portion is raised to a highest level and includes a frame that is adapted to arrange the seat portion in an upright position. In the second mode, the seat portion is lowered to a level that is lower than the highest level.

23 Claims, 11 Drawing Sheets

U.S. PATENT DOCUMENTS 5,364,137 A * 11/1994 Shimer ..... 297/130 X
5,413,399 A * 5/1995 Myers et al. ..... 297/118
5,431,478 A * 7/1995 Noonan ..... 297/130
5,527,096 A * 6/1996 Shimer ..... 297/130 X
5,564,778 A * 10/1996 Shimer et al. ..... 297/130
5,806,922 A * 9/1998 Mendelovich ..... 297/130
5,829,826 A * 11/1998 Ziccardi ..... 297/118
5,992,932 A * 11/1999 Kain et al. ..... 297/153
6,010,184 A * 1/2000 Lee et al. ..... 297/130
6,050,643 A * 4/2000 Kain et al. ..... 297/130 X
6,070,890 A * 6/2000 Haut et al. ..... 297/130 X
6,074,007 A * 6/2000 Helmsderfer et al. .... 297/118 X
6,082,814 A * 7/2000 Celestina-Krevh et al. .. 297/118
6,089,653 A * 7/2000 Hotaling et al. ..... 297/130
6,089,654 A * 7/2000 Burstein ..... 297/151
6,203,102 B1 * 3/2001 Helmsderfer et al. ..... 297/130
6,224,148 B1 * 5/2001 Lee et al. ..... 297/130
6,331,032 B1 * 12/2001 Haut et al. ..... 297/130
6,421,901 B2 * 7/2002 Sitarski et al. ..... 297/130 X
6,511,123 B1 * 1/2003 Sitarski et al. ..... 297/130
6,619,734 B2 * 9/2003 Helmsderfer ..... 297/130
6,877,801 B2 * 4/2005 Asbach et al. ..... 297/153 X
6,951,371 B2 * 10/2005 Wang ..... 297/130 X
7,673,934 B2 * 3/2010 Bearup et al. ..... 297/130
2001/0028184 A1 * 10/2001 Sitarski et al. ..... 297/118
2003/0011221 A1 * 1/2003 Yoshie et al. ..... 297/130
2003/0151285 A1 * 8/2003 Keegan et al. ..... 297/130 X

* cited by examiner

CONVERTIBLE HIGH CHAIR

CROSS-REFERENCE TO RELATED APPLICATION

This claims priority from U.S. Provisional Application for Patent No. 61/037,852, which was filed on Mar. 19, 2008.

FIELD OF THE INVENTION

The invention relates to chairs for supporting children, and in particular to high chairs.

BACKGROUND OF THE INVENTION

It is well known that as children grow from infants to toddlers, many of their needs change. They grow in size, and their ability to support themselves and control their movements also increases. For example, infants generally require a great deal of support, particularly when in a somewhat upright position, such as when eating. While feeding an infant, a parent typically holds the infant for support, or places the infant in a seat designed for infants that supports the back and head and secures the infant snugly in position, not allowing substantial freedom of movement. In order to place the seated infant at a height that allows for easy feeding, the infant seat is usually placed on a tabletop near where the feeding parent is seated. This arrangement takes up table space and generally doesn't allow the feeding parent to eat also.

When the child reaches a more advances stage of development, upright seating is possible with much less support, and better control of movement makes it more appropriate to allow more freedom of movement to the child. At this stage, the child is typically fed while seated in a high chair. The transition from an infant seat that requires placement on a table top to a high chair frees up room on the table, allowing a parent to perform other tasks, such as eating, while feeding the child. It would be beneficial to provide a high chair that also allows feeding of an infant who isn't ready for a high chair, so that the advantages of highchair use can be realized at an earlier point in the child's development.

BRIEF SUMMARY OF THE INVENTION

A chair includes a base portion, and a seat portion supported by the base portion. The seat portion is configurable in at least two modes. In the first mode, the seat portion is raised to a highest level and includes a frame that is adapted to arrange the seat portion in an upright position. In the second mode, the seat portion is lowered to a level that is lower than the highest level.

The seat portion can be configurable in a third mode, in which the seat portion is stowed in a non-seating position.

The seat portion can include a tray on which the frame is disposed in the first mode.

In the second mode, the seat portion can include a backrest that is adapted to recline. For example, the chair can include a backrest locking mechanism for selectable locking of the backrest in one of a plurality of reclining positions. The backrest locking mechanism can be manipulable to unlock the chair from the second mode for positioning in the first mode.

The can also include release buttons on the seat portion that are manipulable to enable changing of the chair from the second mode to the first mode.

The chair can also include a mechanism for changing a height of the seat portion when the seat portion is in the second mode.

The seat portion can include a tray disposed toward a front of the seat portion in the second mode. The seat portion can include a seat back, and the tray can engage the seat portion in an adjustable manner such that the distance between the seat back and the tray can be adjusted.

DETAILED DESCRIPTION OF THE INVENTION

The invention is a high chair that converts from a configuration suitable for use by an infant to a configuration suitable for use by an older child, such as a toddler. The invention provides an infant seat on a raised surface so that a tabletop footprint is not necessary. The same apparatus can then be converted to a more conventional high chair configuration, allowing for developmental growth of the child without the need to purchase an additional piece of furniture. In either operational mode, the other configuration is stored underneath the seat being used. The chair also has a storage configuration in which both seats are stowed.

Figure 1:
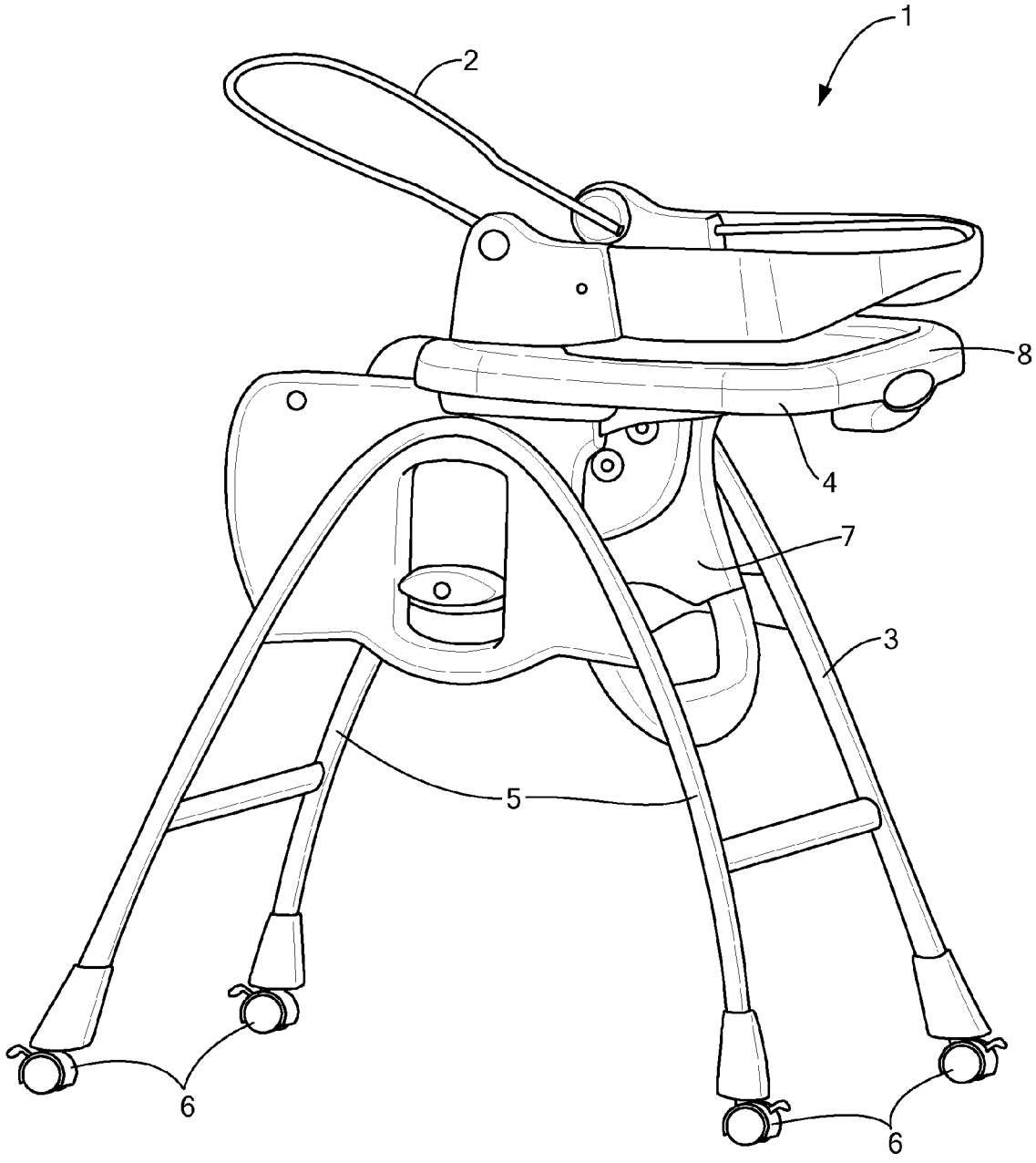
FIG. 1 shows an embodiment of the invention in infant mode.

FIG. 1 shows the chair 1 in infant mode. For clarity, only the frame of the infant seat 2 is shown. In normal usage, the frame 2 will be covered with a fabric sling or other seating arrangement to support the infant. As shown, the high chair 1 has a base 3 on which the convertible seat 4 is disposed. The base includes legs 5, optionally with castors 6 or wheels on the bottom ends, and a convertible seat mechanism 4 at or near the top end of the base 3. In this configuration, the infant seat 2 is in an elevated position, and the toddler seat 7 is stored beneath the infant seat 2. The feeding tray 8 used in the toddler configuration preferably is in a raised horizontal position, and provides a platform on which the infant seat 2 at least partially rests.

Figure 2:
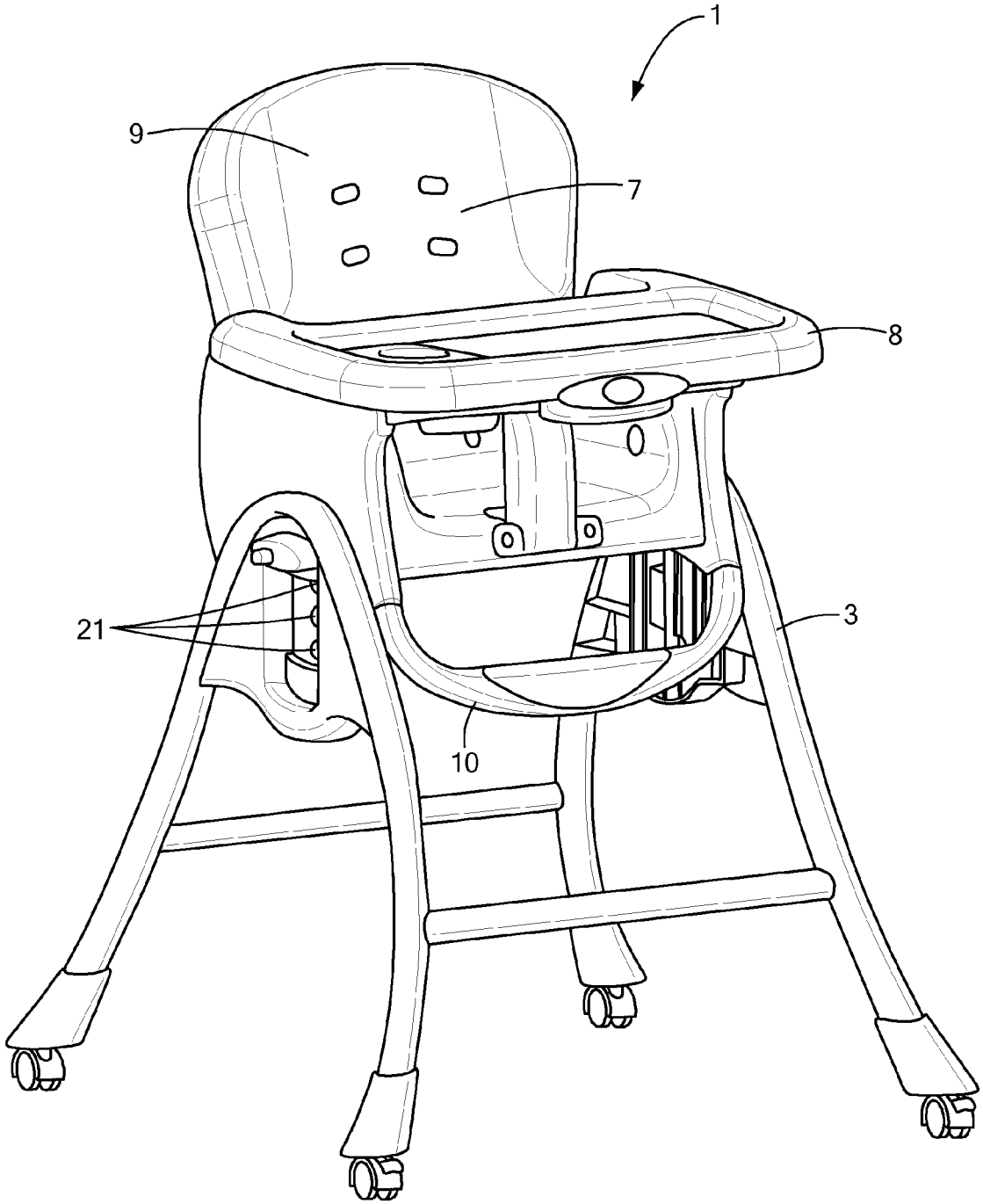
FIG. 2 shows an embodiment of the invention in toddler mode
Figure 3:
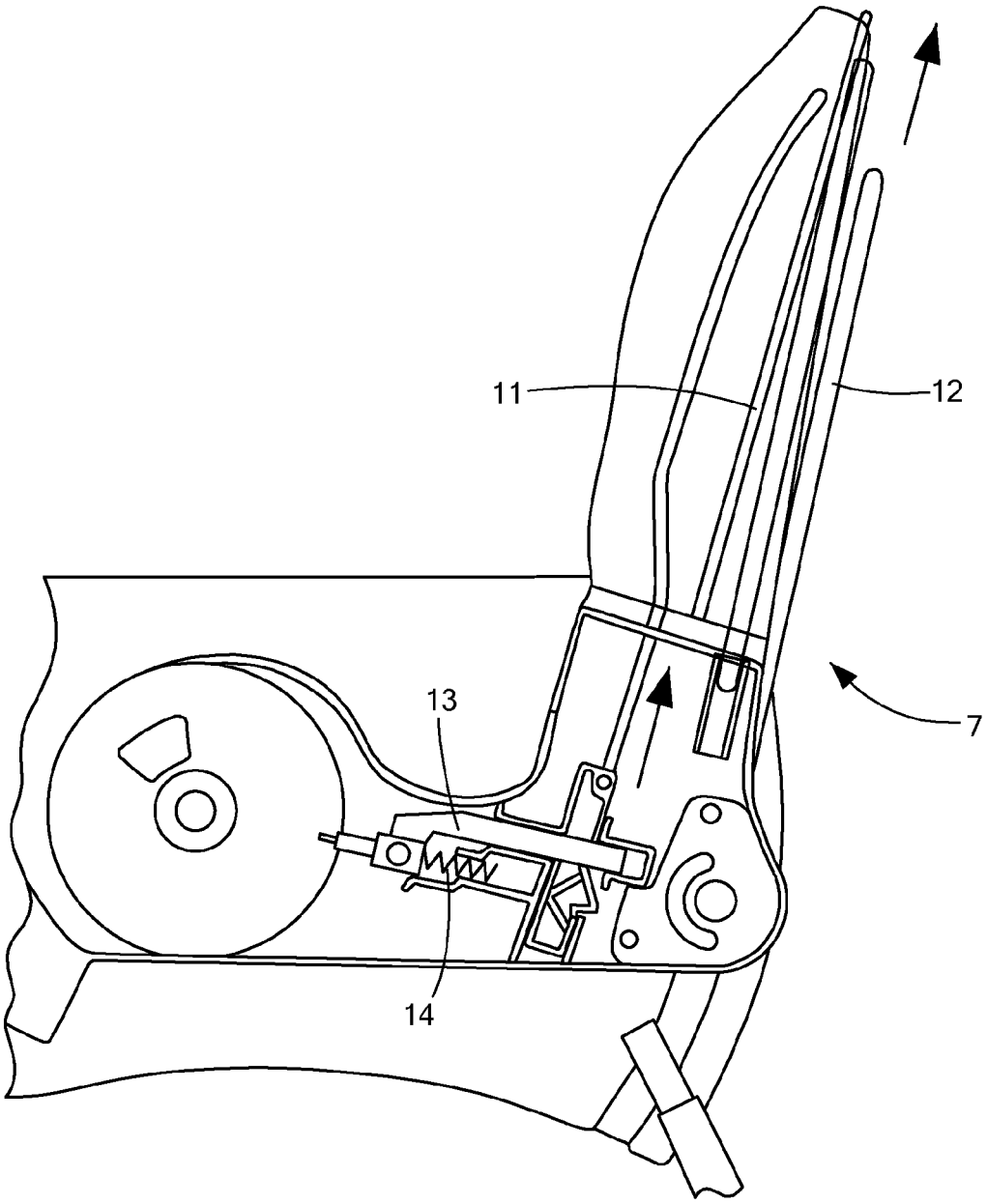
FIG. 3 shows a recline feature of the backrest of the toddler seat.
Figure 4:
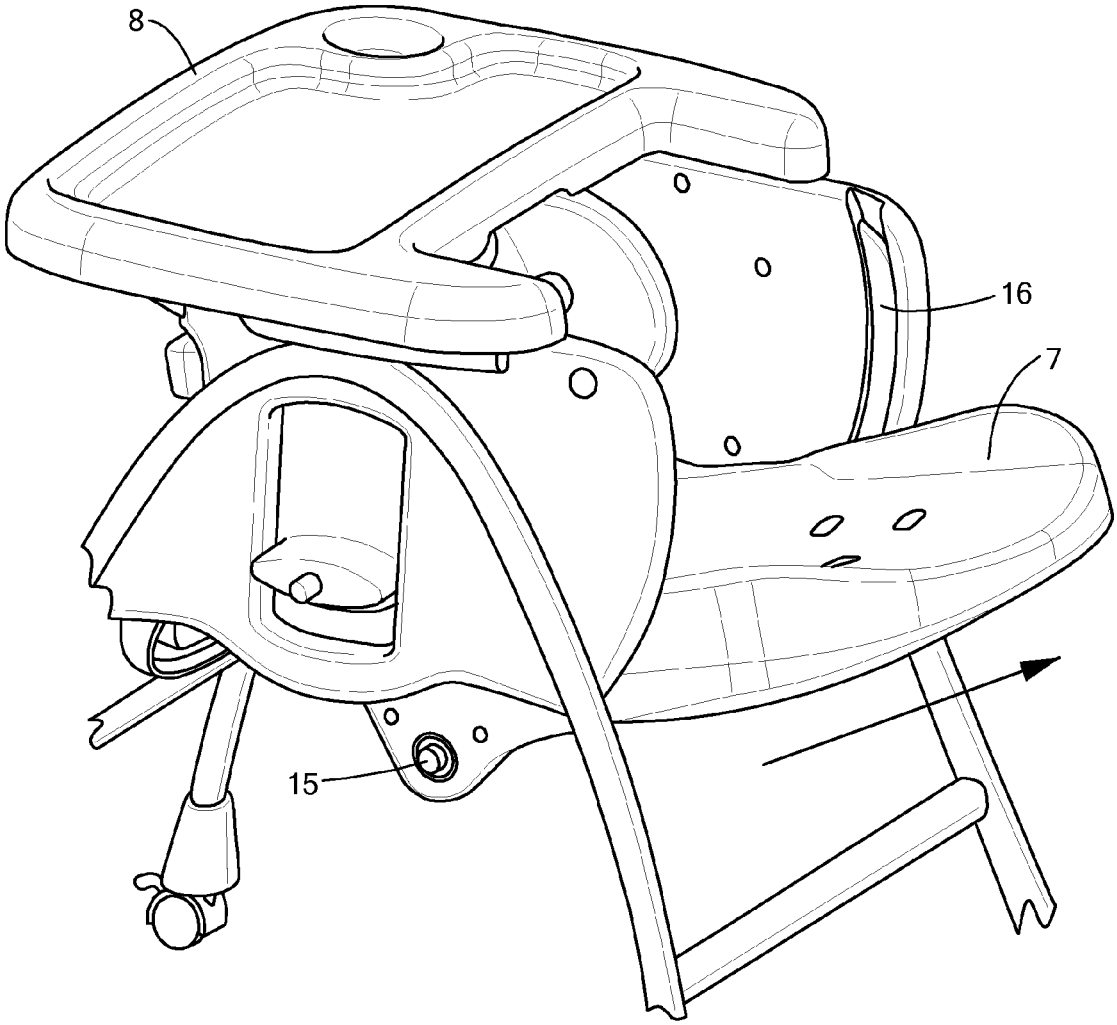
FIG. 4 shows a mechanism for sliding the toddler seat under the tray and into a storage position.

FIG. 2 shows the chair 1 in toddler mode. In this configuration, the high chair 1 is arranged as a conventional-type high chair, with a seat 9, tray 8, and footrest 10 arranged at or near the top of the base 3. In this configuration, the infant seat 2 is stored beneath the toddler seat 7. As shown in FIG. 3, the backrest 11 of the toddler seat 7 can be made to recline. In the exemplary embodiment shown in the drawing, a recline handle rod 12 is disposed behind the back 11 of the toddler seat 7. Pulling the handle rod 12 upward causes a lock slide 13 in the seat bottom to move backward, disengaging the seat back lock 14 and allowing the seat back 11 to recline. Preferably, a number of recline stops can be engaged by the seat back lock 14 so that different reclining angles can be selected. This locking mechanism 14 is also used to begin to convert the high chair 1 to infant mode, or to allow the high chair 1 to be folded into a storage configuration. As shown in FIG. 4, the toddler seat 7 can slide under the tray 8 and down into a storage position when unlocked.

Figure 5:
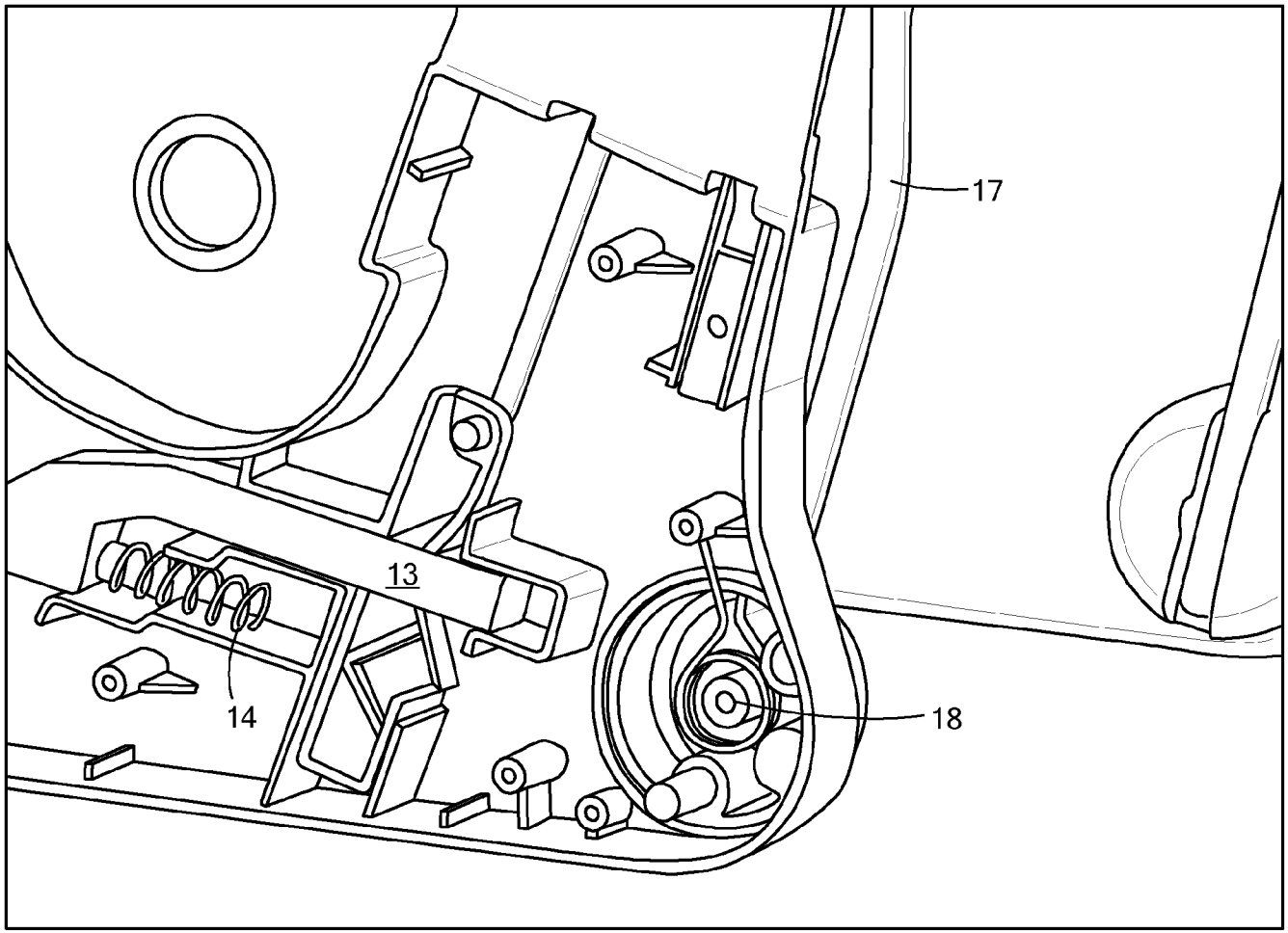
FIG. 5 shows a mechanism for rotating the infant seat into a usable position.
Figure 6:
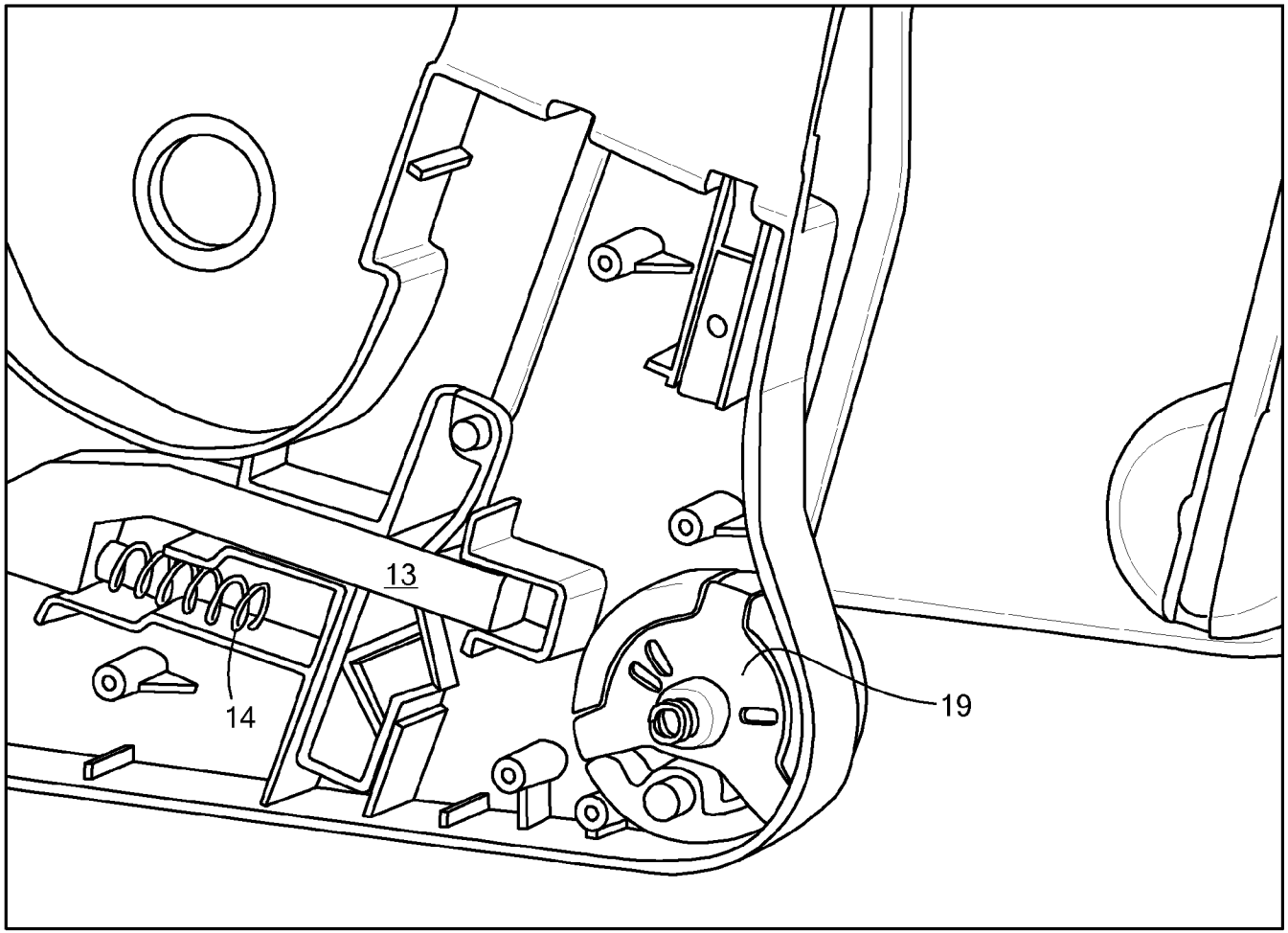
FIG. 6 shows a mechanism for selecting from among three positions of the chair.
Figure 7:
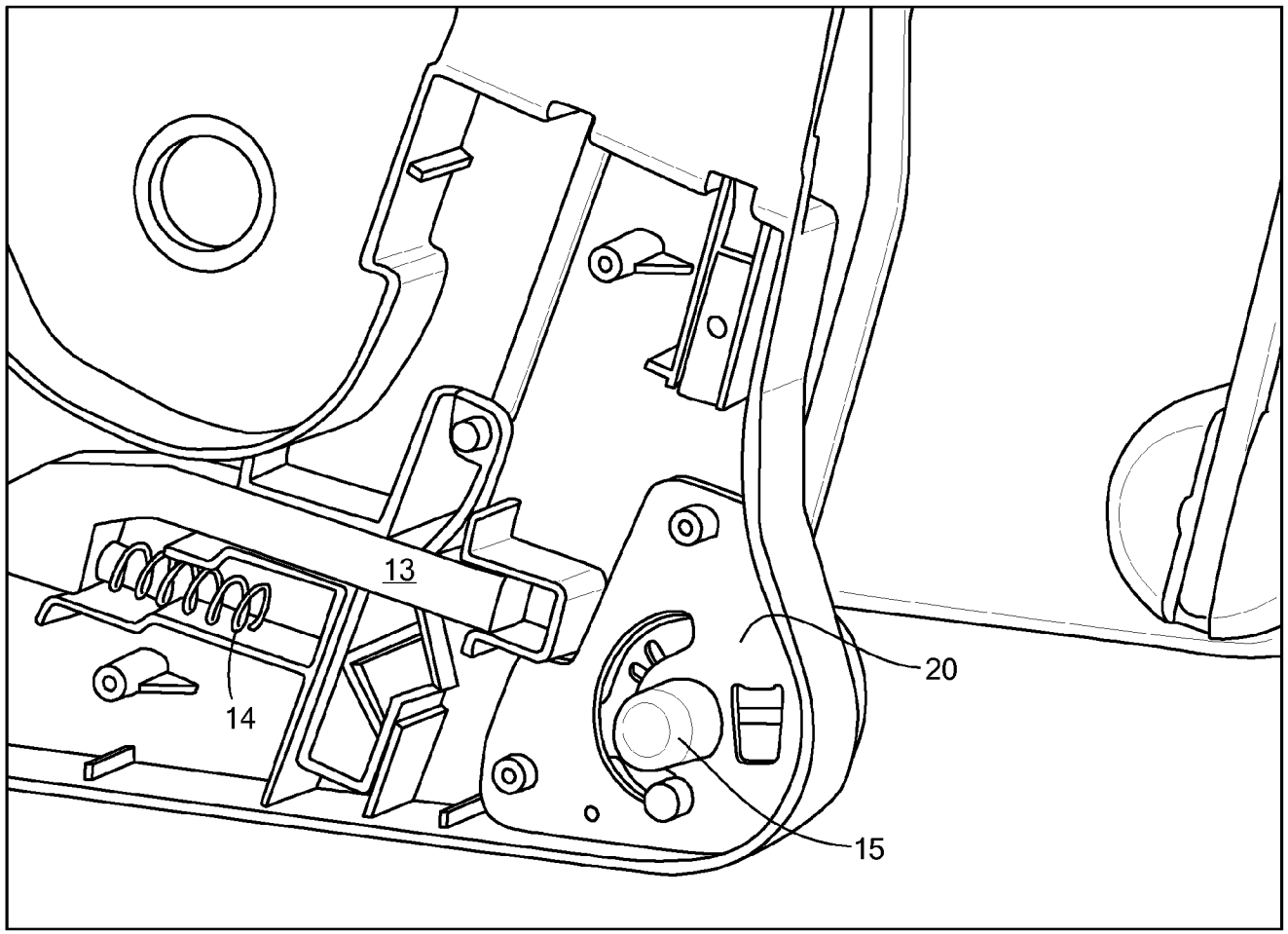
FIG. 7 shows a mechanism for selecting from among three positions of the chair.

As also shown in FIG. 4, release buttons 15 on either side of the toddler seat 7 track corresponding ramps 16 on either side of the frame of the seating mechanism. When the buttons 15 are depressed, a head loop 17 is sprung open to allow the infant seat 2 to be raised into the use position. As shown in FIG. 5, the release button manipulates a torsion spring 18 that is under tension when the infant seat 2 is in a storage position. When the release buttons 15 on either side are depressed, the head loop 17 is sprung into infant position so that the infant seat 2 can be rotated into a usable position. A compression spring forces a release plate 19 into engagement with a lock plate 20, as shown in FIG. 6. This lock plate 20 can be used to select a number of positions. For example, three positions are specified in the exemplary embodiment shown: the storage position, and two different reclining positions in the use configuration. As the release button 15 is depressed, the release plate 19 is disengaged from the lock plate 20 to allow the head loop 17 to spring open or to be moved into a selected one of the three positions, as shown in FIG. 7.

Figure 8:
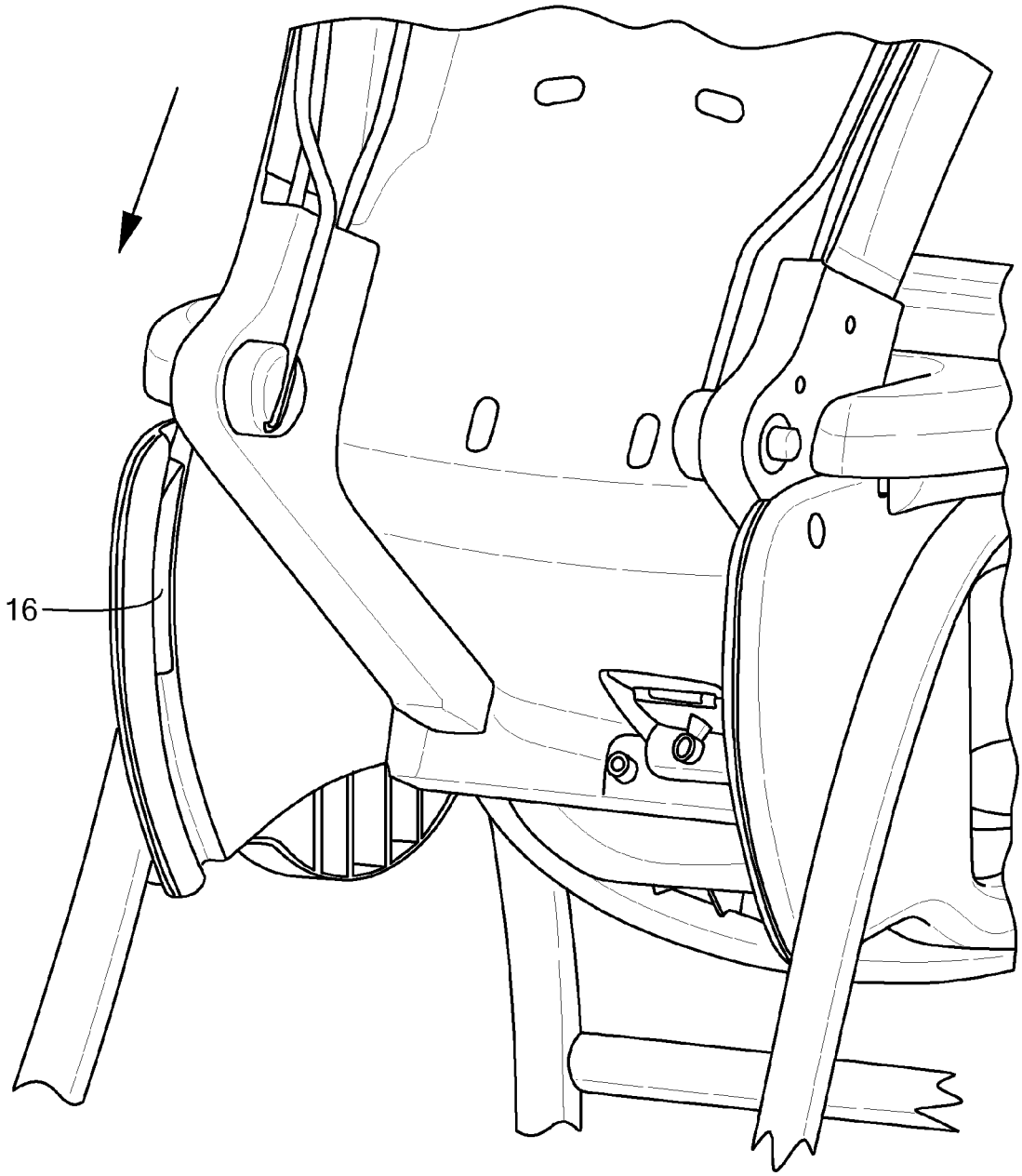
FIG. 8 shows a mechanism for switching back to toddler mode from infant mode.
Figure 9:
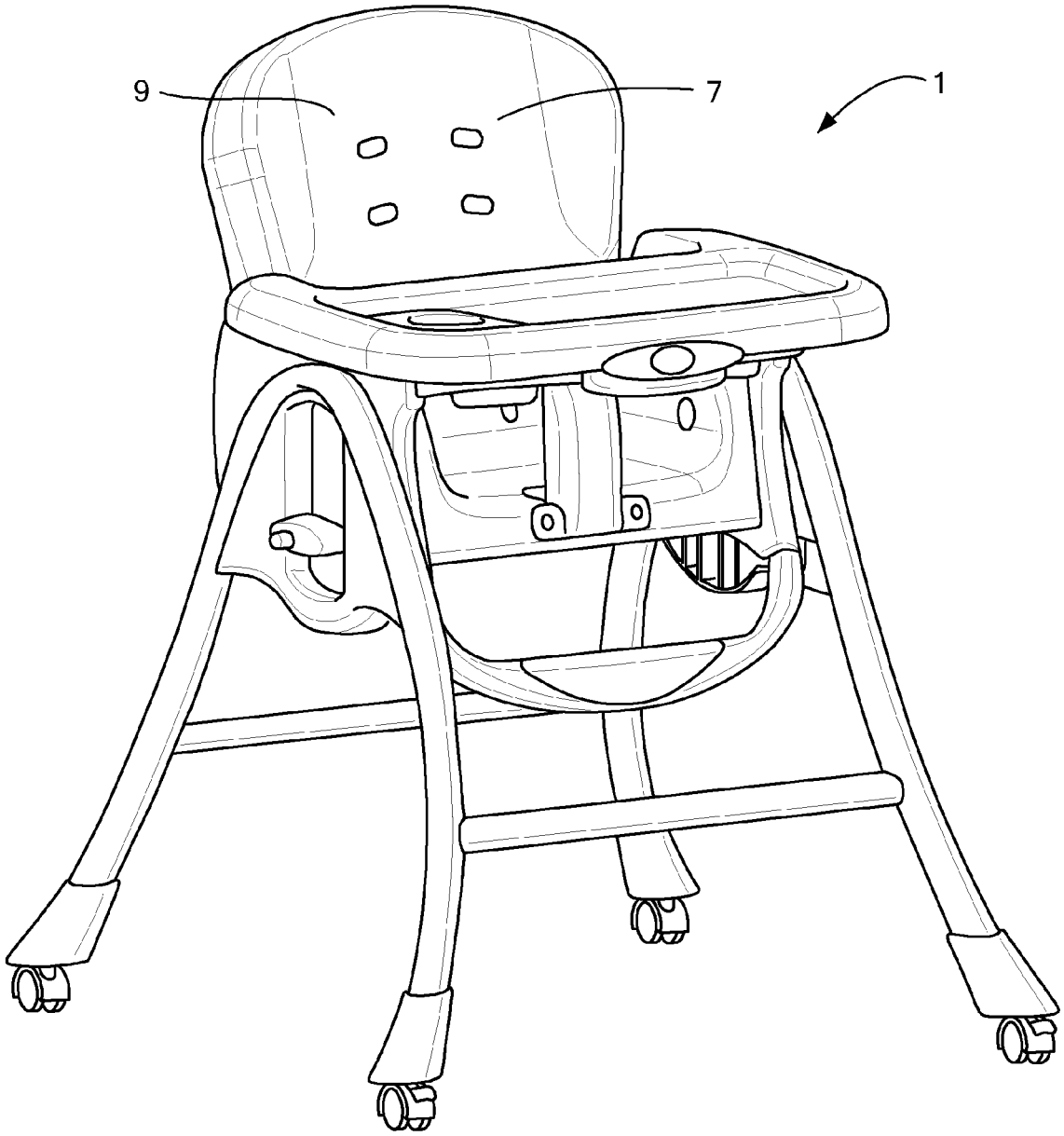
FIG. 9 shows an embodiment of the chair in toddler mode.

As shown in FIG. 8, when switching back to toddler mode from infant mode, the release buttons 15 force the ramps 16 out of the way instead of depressing. Therefore, the sprung ramp 16 can rotate forward to allow the release buttons 15 to pass, and the toddler seat 7 is put into the use position. FIG. 9 shows the chair 1 in the toddler mode once again. While in the toddler mode, the height of the seat can be adjusted to a suitable position. In the embodiment shown in FIG. 9, the seat is in the lowest position, in contrast to FIG. 2, which shows the seat in the highest position. The exemplary embodiment shown in the figures includes stops 21 for four different heights for the seat, but it is contemplated that the high chair can be adapted to include any number of adjustable stops for the height of the seat.

Figure 10:
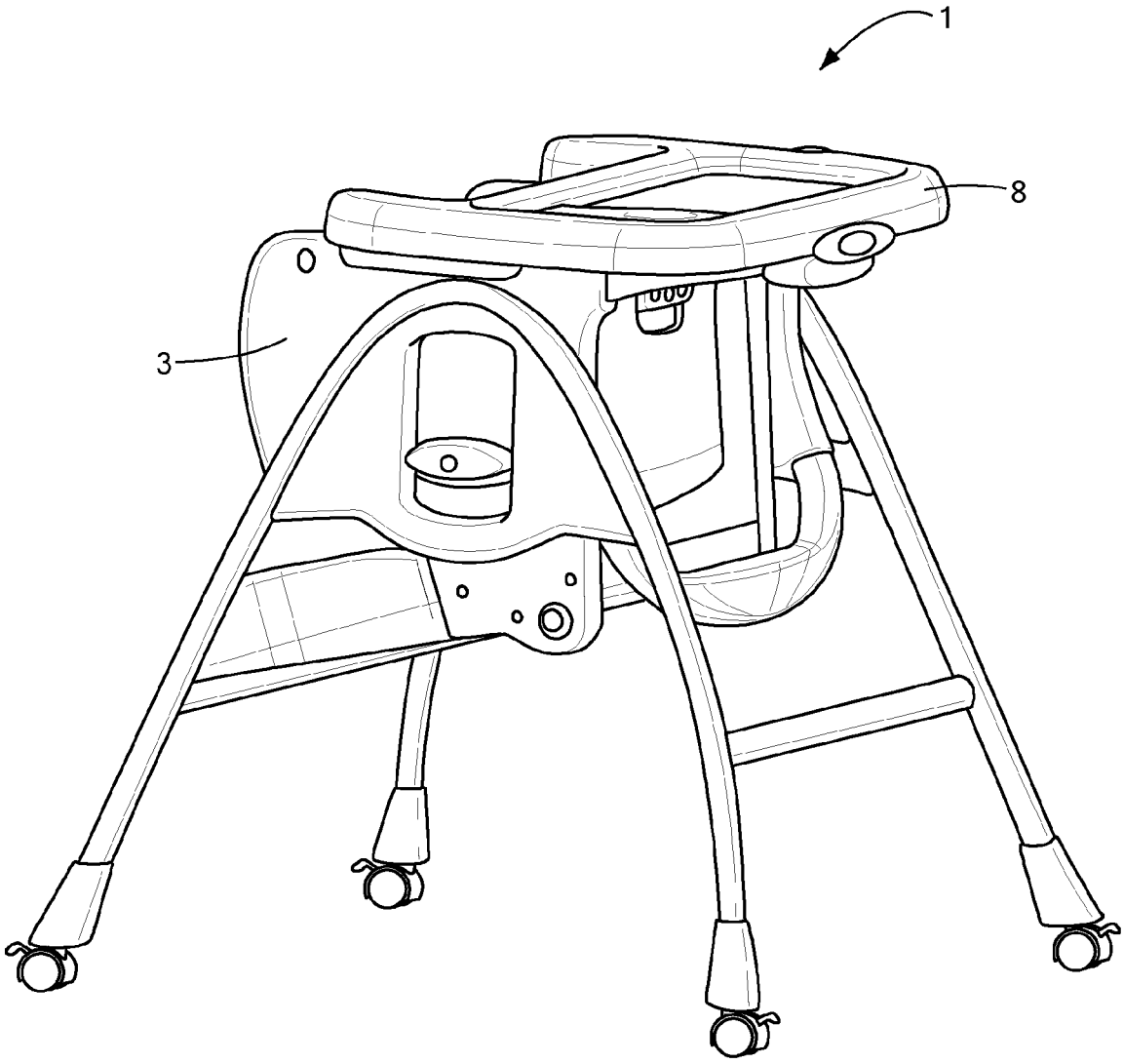
FIG. 10 shows an embodiment of the chair in a storage configuration.

FIG. 10 shows the chair in a storage configuration. In this mode, both the toddler seat 7 and the infant seat 2 are stowed below the tray 8 and substantially enclosed by the legs 5 of the base 3. This configuration allows for a compact profile for easy storage.

Figure 11:
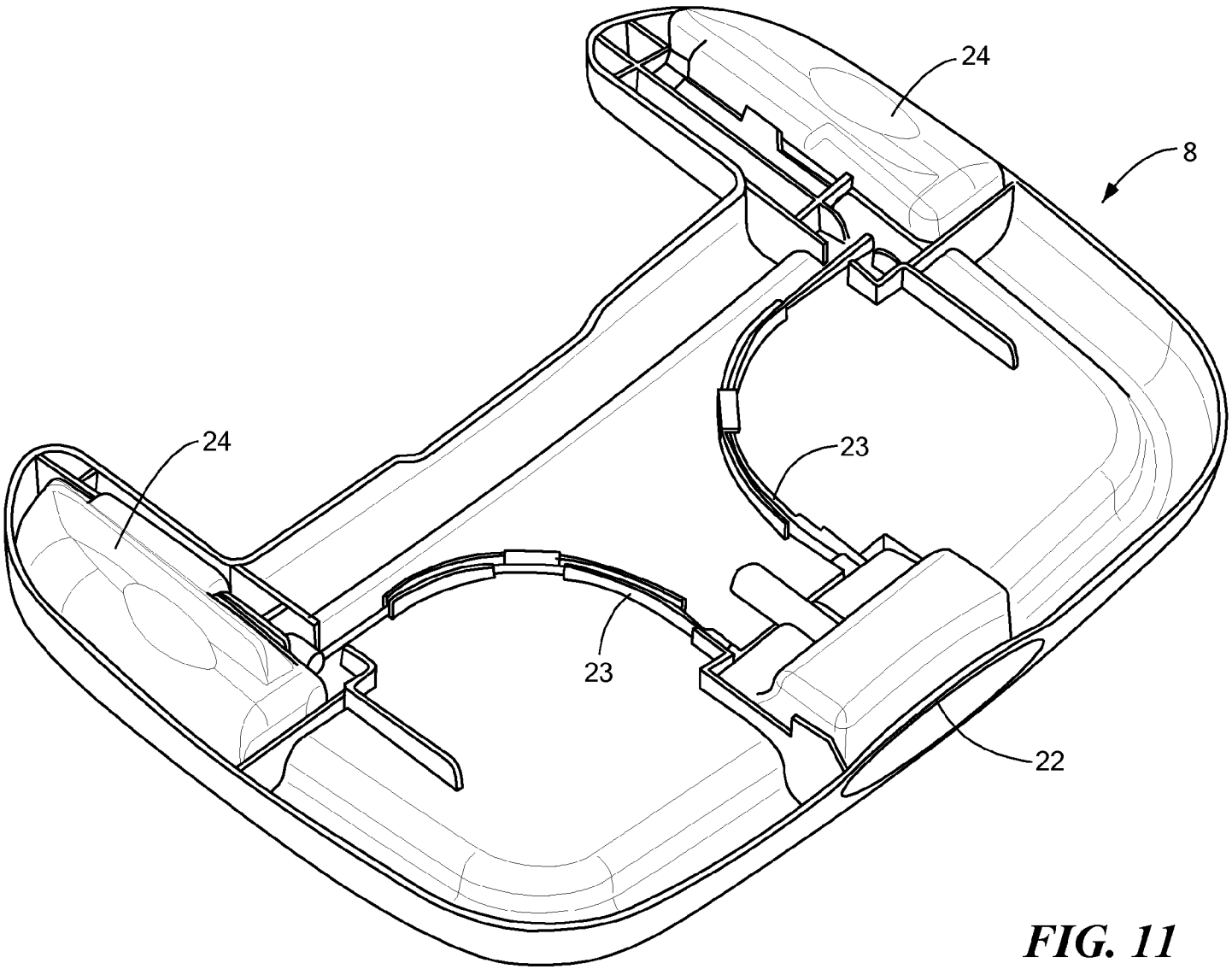
FIG. 11 shows the underside of the tray.

The tray 8 is also adjustable to a number of different positions, for ease of entry and exit, and for the comfort and convenience of the child in the seat in toddler mode, as well as to provide a stable and convenient platform for the infant-mode seat. The underside of the tray 8 is shown in FIG. 11. As shown, this exemplary embodiment includes a release 22 at the front-center of the underside of the tray 8. When this release 22 is squeezed to pull the cover forward, flex straps 23 on either side of the tray 8 are moved backward and outward. Movement of the flex straps 23 causes release handles 24 on either side of the tray 8 to spread outward, releasing them from mating connectors on the chair 1. While in this position, the tray 8 can be slid along the mating connector to a desired position, at which point the front release 22 can be returned to its original, unsqueezed position, preferably by a spring or other biasing means. The return of the release 22 relaxes the flex straps 23, causing the side handles 24 to engage the mating connectors, securing the tray 8 in the selected position. Preferably, the tray 8 can also be removed completely from the rest of the chair 1 using this mechanism.

The present invention has been described by way of example and in terms of preferred embodiments. However, it is to be understood that the present invention is not strictly limited to the disclosed embodiments. To the contrary, various modifications, as well as similar arrangements, are included within the spirit and scope of the present invention. The scope of the appended claims, therefore, should be accorded the broadest possible interpretation so as to encompass all such modifications and similar arrangements.

I claim:

1. A chair, comprising:

a base portion; and a seat portion supported by the base portion;

wherein the seat portion includes an infant seat and a toddler seat, which are arranged for selected alternate support of a child;

wherein the infant seat includes a reclining child support that is adapted to support an infant's back and head;

wherein the toddler seat includes a backrest and is adapted to support a toddler in an upright seated position;

wherein the chair further comprises a convertible seat mechanism that allows the selected one of the infant seat and the toddler seat to be arranged in a use position for support of an infant or toddler and the other of the infant seat and the toddler seat to be stowed in an unused position within the base portion; and wherein the convertible seat mechanism allows both the infant seat and the toddler seat to be arranged in unused positions within the base portion.

2. A chair, comprising:

a base portion; and a seat portion supported by the base portion;

wherein the seat portion includes an infant seat and a toddler seat, which are arranged for selected alternate support of a child;

wherein the infant seat includes a reclining child support that is adapted to support an infant's back and head;

wherein the toddler seat includes a backrest and is adapted to support a toddler in an upright seated position;

wherein the chair further comprises a convertible seat mechanism that allows the selected one of the infant seat and the toddler seat to be arranged in a use position for support of an infant or toddler and the other of the infant seat and the toddler seat to be stowed in an unused position within the base portion; and wherein the seat portion includes a tray on which the infant seat is disposed when in the use position.

3. A chair, comprising:

a base portion; and a seat portion supported by the base portion;

wherein the seat portion includes an infant seat and a toddler seat, which are arranged for selected alternate support of a child;

wherein the infant seat includes a reclining child support that is adapted to support an infant's back and head;

wherein the toddler seat includes a backrest and is adapted to support a toddler in an upright seated position;

wherein the chair further comprises a convertible seat mechanism that allows the selected one of the infant seat and the toddler seat to be arranged in a use position for support of an infant or toddler and the other of the infant seat and the toddler seat to be stowed in an unused position within the base portion; and wherein the backrest of the toddler seat is adapted to recline.

4. The chair of claim 3, including a backrest locking mechanism for selectable locking of the backrest in one of a plurality of reclining positions.

5. The chair of claim 4, wherein the backrest locking mechanism is manipulable to unlock the convertible seat mechanism so that the toddler seat can be arranged in the unused position.

6. A chair, comprising:

a base portion; and a seat portion supported by the base portion;

wherein the seat portion includes an infant seat and a toddler seat, which are arranged for selected alternate support of a child;

wherein the infant seat includes a reclining child support that is adapted to support an infant's back and head;

wherein the toddler seat includes a backrest and is adapted to support a toddler in an upright seated position; and wherein the chair further comprises a convertible seat mechanism that allows the selected one of the infant seat and the toddler seat to be arranged in a use position for support of an infant or toddler and the other of the infant seat and the toddler seat to be stowed in an unused position within the base portion;

further comprising release buttons on the seat portion that are manipulable to enable arrangement of the infant seat into the use position.

7. A chair, comprising:

a base portion; and a seat portion supported by the base portion;

wherein the seat portion includes an infant seat and a toddler seat, which are arranged for selected alternate support of a child;

wherein the infant seat includes a reclining child support that is adapted to support an infants back and head;

wherein the toddler seat includes a backrest and is adapted to support a toddler in an upright seated position; and wherein the chair further comprises a convertible seat mechanism that allows the selected one of the infant seat and the toddler seat to be arranged in a use position for support of an infant or toddler and the other of the infant seat and the toddler seat to be stowed in an unused position within the base portion;

including a mechanism for changing a height of the seat portion when the toddler seat is in the use position.

8. A chair, comprising:

a base portion; and a seat portion supported by the base portion;

wherein the seat portion includes an infant seat and a toddler seat, which are arranged for selected alternate support of a child;

wherein the infant seat includes a reclining child support that is adapted to support an infant's back and head;

wherein the toddler seat includes a backrest and is adapted to support a toddler in an upright seated position;

wherein the chair further comprises a convertible seat mechanism that allows the selected one of the infant seat and the toddler seat to be arranged in a use position for support of an infant or toddler and the other of the infant seat and the toddler seat to be stowed in an unused position within the base portion; and wherein the seat portion includes a tray disposed toward a front of the seat portion when the toddler seat is in the use position.

9. The chair of claim 8, wherein the tray engages the toddler seat in an adjustable manner such that the distance between the backrest and the tray can be adjusted.

10. A chair, comprising:

a base portion; and a seat portion supported by the base portion;

wherein the seat portion includes a toddler seat, which is arranged for selected support of a child;

wherein the toddler seat includes a backrest and is adapted to support a toddler in an upright seated position;

wherein the chair further comprises a convertible seat mechanism that allows the toddler seat to be selectively arranged in a use position for support of a toddler and stowed in an unused position within the base portion without disconnection of the toddler seat from the base portion;

wherein the seat portion further includes an infant seat;

wherein the infant seat includes a reclining child support that is adapted to support an infant's back and head;

wherein the infant seat and the toddler seat are arranged for selected alternate support of a child; and wherein the convertible seat mechanism allows both the infant seat and the toddler seat to be arranged in unused positions within the base portion.

11. The chair of claim 10, wherein the backrest of the toddler seat is adapted to recline.

12. The chair of claim 11, including a backrest locking mechanism for selectable locking of the backrest in one of a plurality of reclining positions.

13. The chair of claim 12, wherein the backrest locking mechanism is manipulable to unlock the convertible seat mechanism so that the toddler seat can be arranged in the unused position.

14. The chair of claim 10, including a mechanism for changing a height of the seat portion when the toddler seat is in the use position.

15. The chair of claim 10, wherein the seat portion includes a tray disposed toward a front of the seat portion when the toddler seat is in the use position.

16. The chair of claim 15, wherein the tray engages the toddler seat in an adjustable manner such that the distance between the backrest and the tray can be adjusted.

17. A chair, comprising:

a base portion; and a seat portion supported by the base portion;

wherein the seat portion includes a toddler seat, which is arranged for selected support of a child;

wherein the toddler seat includes a backrest and is adapted to support a toddler in an upright seated position;

wherein the chair further comprises a convertible seat mechanism that allows the toddler seat to be selectively arranged in a use position for support of a toddler and stowed in an unused position within the base portion without disconnection of the toddler seat from the base portion;

wherein the seat portion further includes an infant seat;

wherein the infant seat includes a reclining child support that is adapted to support an infant's back and head;

wherein the infant seat and the toddler seat are arranged for selected alternate support of a child; and wherein the seat portion includes a tray on which the infant seat is disposed when in the use position.

18. The chair of claim 17, wherein the backrest of the toddler seat is adapted to recline.

19. The chair of claim 18, including a backrest locking mechanism for selectable locking of the backrest in one of a plurality of reclining positions.

20. The chair of claim 19, wherein the backrest locking mechanism is manipulable to unlock the convertible seat mechanism so that the toddler seat can be arranged in the unused position.

21. The chair of claim 17, including a mechanism for changing a height of the seat portion when the toddler seat is in the use position.

22. The chair of claim 17, wherein the seat portion includes a tray disposed toward a front of the seat portion when the toddler seat is in the use position.

23. The chair of claim 22, wherein the tray engages the toddler seat in an adjustable manner such that the distance between the backrest and the tray can be adjusted.

* * * * *